US006923481B2

(12) United States Patent
Bruderick et al.

(10) Patent No.: US 6,923,481 B2
(45) Date of Patent: Aug. 2, 2005

(54) FLUSH EXTERIOR DOOR HANDLE

(75) Inventors: Mark L Bruderick, Clarkston, MI (US); Richard P Thomas, Clarkston, MI (US); Daniel J Pearlman, Oxford, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 85 days.

(21) Appl. No.: 10/342,784

(22) Filed: Jan. 15, 2003

(65) Prior Publication Data

US 2004/0135380 A1 Jul. 15, 2004

(51) Int. Cl.[7] ..... E05C 3/00

(52) U.S. Cl. ..... 292/336.3; 292/348; 292/352; 292/DIG. 23; 292/DIG. 31; 49/502; 16/361

(58) Field of Search ..... 16/361, 412; 292/DIG. 61, 292/DIG. 37, 336.3, DIG. 31, DIG. 23; 49/502, 503, 394

(56) References Cited

U.S. PATENT DOCUMENTS

| | | | | | |
|---|---|---|---|---|---|
| 2,777,156 | A | * | 1/1957 | Weisgarber | 16/361 |
| 3,909,051 | A | * | 9/1975 | Nakai | 292/166 |
| 4,485,524 | A | * | 12/1984 | Neville | 16/241 |
| 4,588,219 | A | * | 5/1986 | Kobayashi et al. | 292/336.3 |
| 4,652,030 | A | * | 3/1987 | Streett | 292/336.3 |
| 4,778,207 | A | * | 10/1988 | Gergoe | 292/336.3 |
| 4,889,373 | A | * | 12/1989 | Ward et al. | 292/336.3 |
| 5,174,619 | A | * | 12/1992 | Bender et al. | 292/336.3 |
| 5,192,097 | A | * | 3/1993 | Su | 292/166 |
| 5,238,276 | A | * | 8/1993 | Burns | 292/347 |
| 5,560,659 | A | * | 10/1996 | Dault | 292/336.3 |
| 5,632,516 | A | * | 5/1997 | Schwab | 292/336.3 |
| 5,651,163 | A | * | 7/1997 | Tamaki | 292/336.3 |
| 6,036,244 | A | * | 3/2000 | Tyves et al. | 292/336.3 |
| 6,099,052 | A | * | 8/2000 | Spitzley | 292/336.3 |
| 6,108,979 | A | * | 8/2000 | Saffran et al. | 49/503 |
| 6,151,755 | A | * | 11/2000 | Rozema | 16/361 |
| 6,152,501 | A | * | 11/2000 | Magi et al. | 292/336.3 |
| 6,158,788 | A | * | 12/2000 | Ikeda et al. | 292/216 |
| 6,367,124 | B1 | * | 4/2002 | Bella et al. | 292/336.3 |
| 6,427,502 | B1 | * | 8/2002 | Zagoroff | 70/208 |
| 6,530,251 | B1 | * | 3/2003 | Dimig | 70/237 |
| 6,598,913 | B2 | * | 7/2003 | Meinke | 292/336.3 |
| 6,685,240 | B2 | * | 2/2004 | Bacon | 292/336.3 |
| 6,698,262 | B2 | * | 3/2004 | Wittwer | 70/208 |

FOREIGN PATENT DOCUMENTS

| | | | |
|---|---|---|---|
| DE | 3427178 | * | 2/1986 |
| DE | 3835265 | * | 4/1990 |
| FR | 1099810 | * | 5/2001 |

* cited by examiner

*Primary Examiner*—Daniel P. Stodola
*Assistant Examiner*—Carlos Lugo
(74) *Attorney, Agent, or Firm*—Ralph E. Smith

(57) ABSTRACT

A handle for a vehicle door is mounted on a frame by a pivot assembly for swinging movement from a door latching position to a door unlatching position. The frame is secured in an interior space of the door in a position such that when the handle is in the latching position, the handle registers with an opening in a door panel, and when the handle is in the unlatching position, the handle extends into the interior space. The pivot assembly has a hinge which provides a floating axis for the swinging movement of the handle, enabling the handle to be shifted laterally outwardly into contact with a flange on the panel when in the latching position, thereby positioning the outer surface of the handle flush with the outer surface of the door panel. A spring urges the handle laterally outwardly into contact with the flange.

10 Claims, 4 Drawing Sheets

FLUSH EXTERIOR DOOR HANDLE

FIELD OF THE INVENTION

The present invention relates generally to door handles and more particularly to a flush exterior door handle for a vehicle door.

BACKGROUND OF THE INVENTION

Typically a paddle-type door handle requires a bezel or frame around the handle to provide a finished appearance. However the bezel not only adds cost and complicates packaging, but detracts from the overall appearance of the door.

SUMMARY OF THE INVENTION

The door handle of the present invention requires no bezel. It is mounted flush with an exterior surface of the door panel to provide a clean, finished appearance. Because no bezel is needed, assembly of the handle is simplified, packaging is made easier and overall appearance is improved.

In accordance with the present invention, a handle is mounted on a frame by a pivot assembly for swinging movement from a door latching position to a door unlatching position. The frame is secured in an interior space of the door in a position such that when the handle is in the latching position, the handle registers with an opening in a door panel, and when the handle is in the unlatching position, the handle extends into the interior space. The pivot assembly has hinge parts which are loosely interengaged to provide a floating axis for the swinging movement of the handle, enabling the handle, when in the latching position, to be shifted laterally outwardly into contact with a flange on the door panel to a position of use in which the outer surface of the handle is flush with the outer surface of the panel. A spring urges the handle laterally outwardly into contact with the flange.

Further in accordance with the invention, a switch is provided for actuating a door latch unlatching mechanism to unlatch the door. The switch has a stem for activating the switch when the stem is moved to an operative position. A cam on the door handle engages the stem and moves the stem to its operative position in response to the swinging movement of the door handle to the unlatching position.

One object of this invention is to provide a door handle having the foregoing feature and capabilities.

Another object is to provide a door handle which is rugged and durable in use, is inexpensive to manufacture and assemble, and when installed provides a clean, flush, finished appearance.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DESCRIPTION OF THE PREFERRED EMBODIMENT

Figure 1:
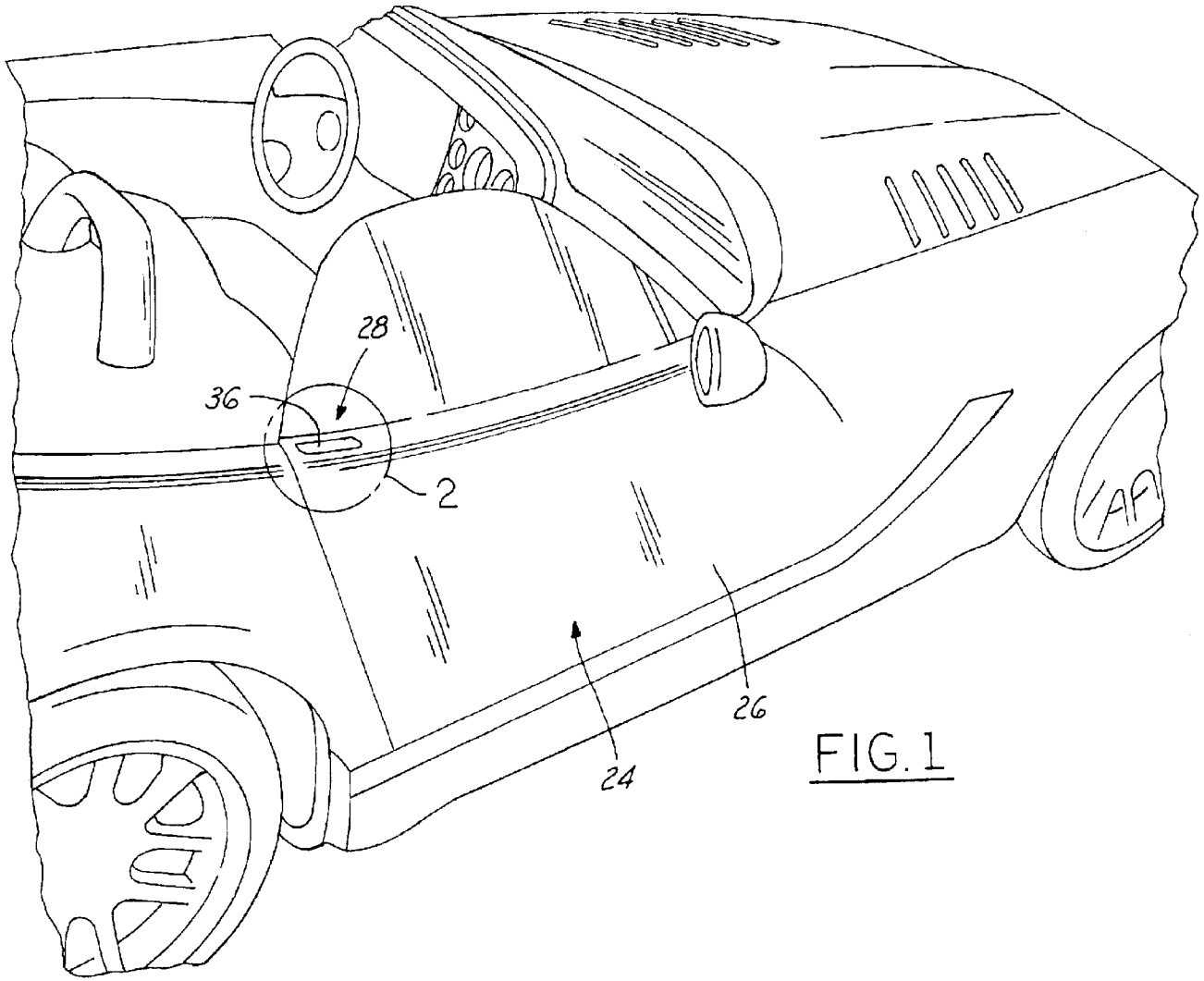
FIG. 1 is fragmentary perspective view of an automotive vehicle having a door handle assembly provided with a flush exterior door handle and mounted on a door of the vehicle, in accordance with the invention.
Figure 2:
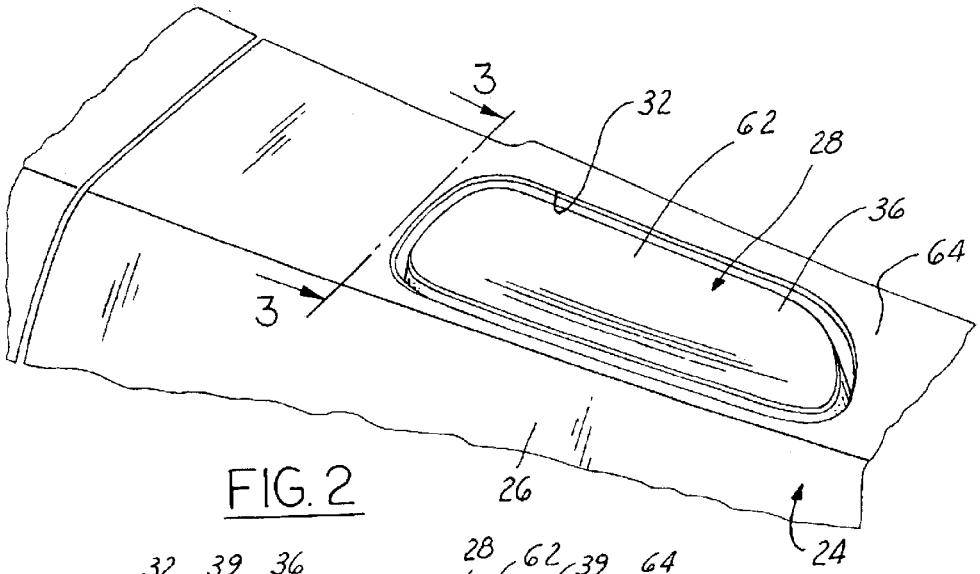
FIG. 2 is an enlarged, fragmentary perspective view of a portion of FIG. 1 within the circle 2.
Figure 3:
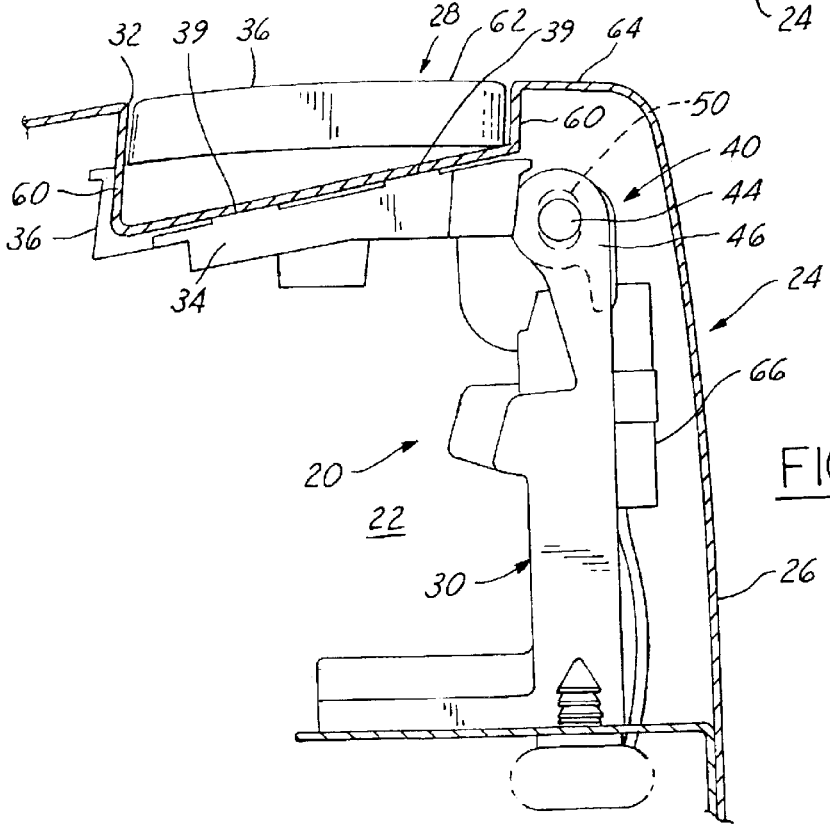
FIG. 3 is a sectional view taken on the line 3—3 in FIG. 2.
Figure 4:
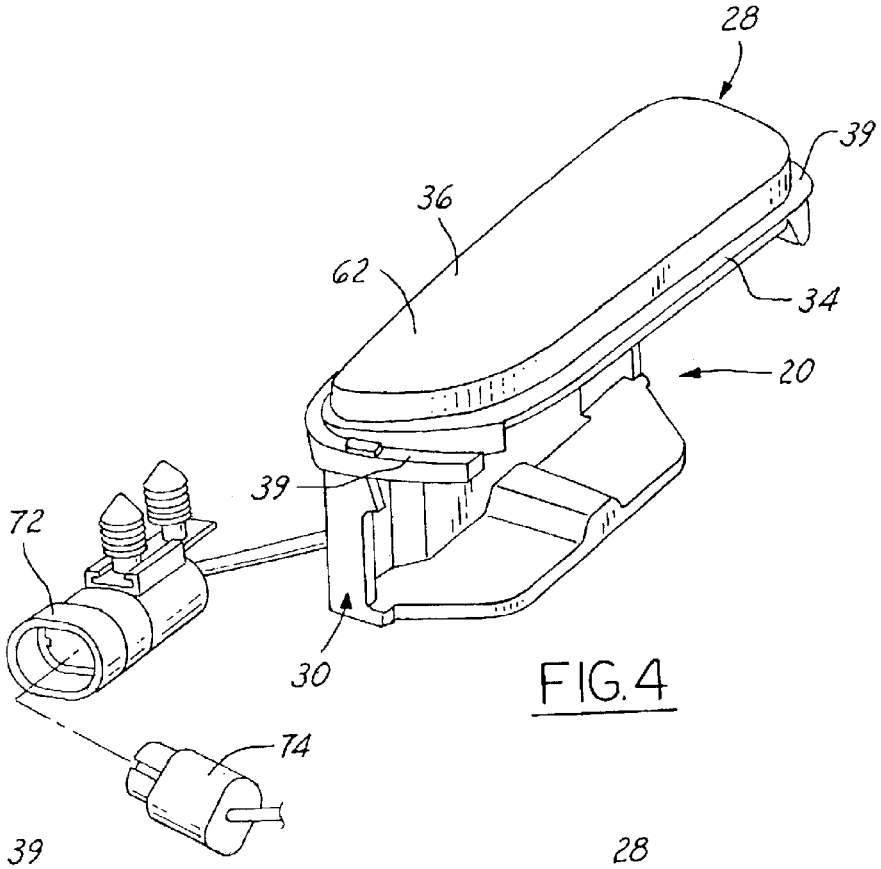
FIG. 4 is a perspective view of the door handle assembly as seen from one side and is shown apart from the vehicle door.
Figure 5:
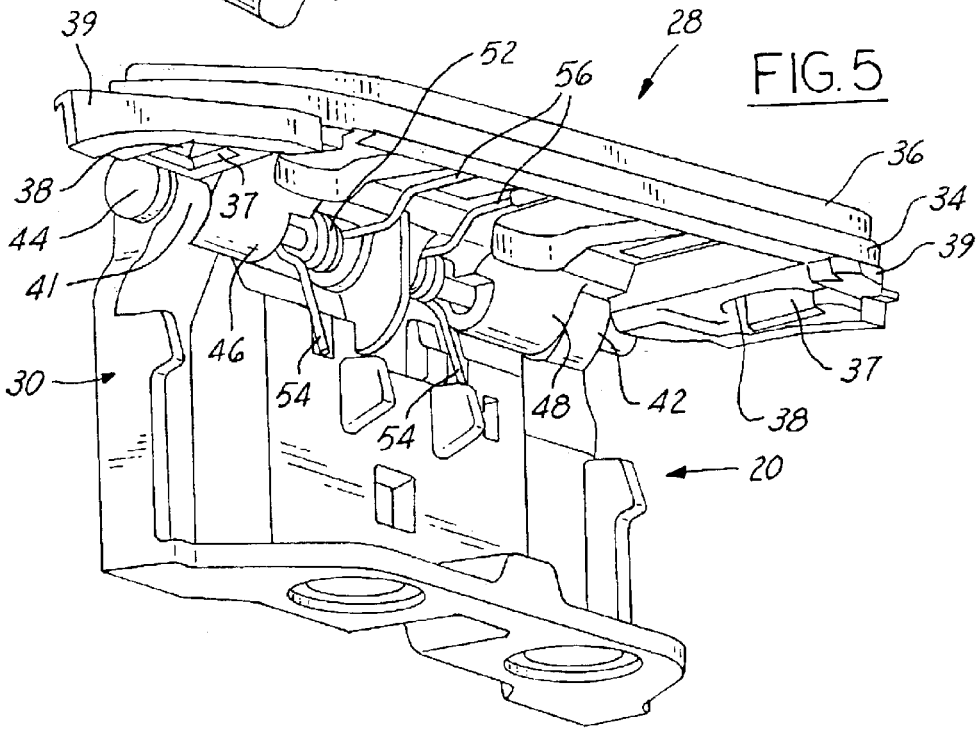
FIG. 5 is a perspective view of the door handle assembly as seen from a different angle.
Figure 6:
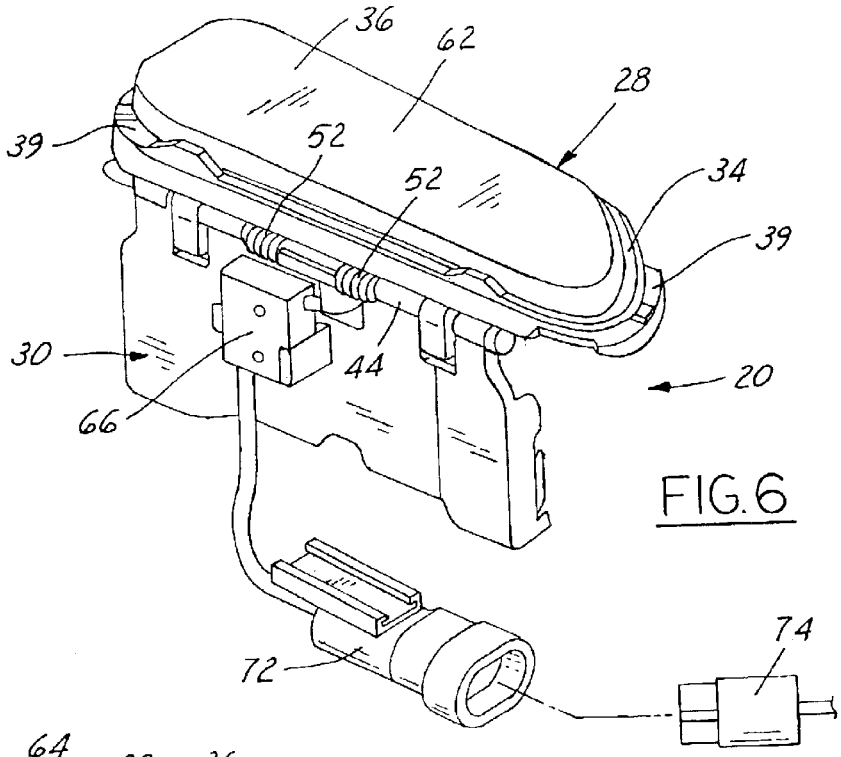
FIG. 6 is a perspective view of the door handle assembly as seen from the opposite side.
Figure 7:
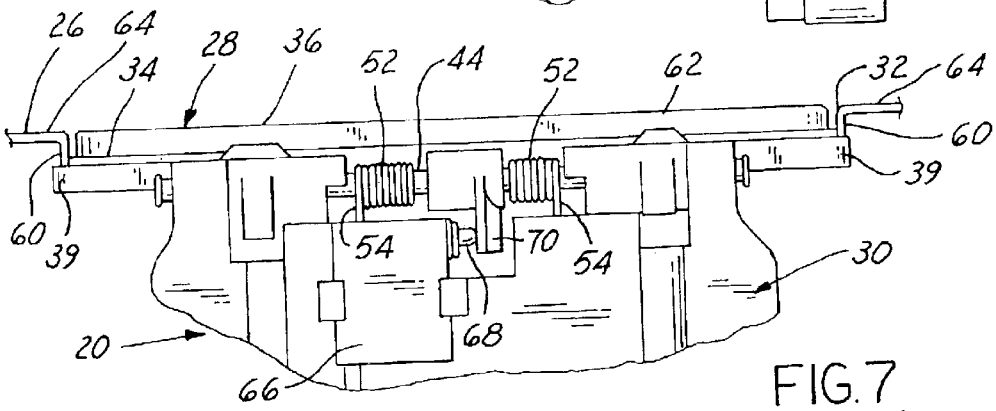
FIG. 7 is a fragmentary elevational view illustrating the switch and associated parts for operating the door latch unlatching mechanism.

The following description of the preferred embodiment is merely exemplary in nature and is in no way intended to limit the invention, its application or uses.

Referring now more particularly to the drawings, a door handle assembly 20 is shown mounted in an interior space 22 of a vehicle door 24 defined in part by an outer door panel 26.

The door handle assembly 20 includes a door handle 28 and a mounting frame 30 to which the door handle is pivoted. The mounted frame is secured in the interior space 22 of the door 24 adjacent to an opening 32 in the outer door panel 26.

The door handle 28 has a base 34 and a cover plate 36 removably secured to the outer surface of the base 34 as by prongs 37 engaged in recesses 38 in the base. The cover plate 36 is the same shape as the opening 32 and is capable of extending into the opening 32 with a close fit. The base 34 is larger than the opening 32 and has locator pads 39 extending outwardly beyond the cover plate 36.

A pivot assembly 40 is provided for the door handle 28 and for this purpose the frame 30 has laterally spaced apart annular hinge pin supports 41 and 42. See FIGS. 3 and 5–7. A hinge pin 44 extends between the hinge pin supports 41 and 42 with its opposite ends secured in the hinge pin supports. The handle 28 has laterally spaced apart hinge knuckles 46 and 48. The hinge knuckles have identical aligned apertures 50 through which the hinge pin 44 extends. The apertures 50 are oval-shaped and elongated in a direction toward the opening 32 providing a loose interengagment between the hinge pin 44 and the knuckles 46 and 48. This loose interengagement provides a floating axis for the swinging movement of the door handle 28 and allows for laterally outward and inward movement of the door handle 28 toward and away from the opening 32.

The handle 28 is capable of swinging movement about the axis of the hinge pin 44 from a door latching position to a door unlatching position. Torsion springs 52 coiled around the hinge pin 44 have arms 54 bearing on the mounting frame 30 and other arms 56 bearing on the base 34 of the handle 28, urging the door handle to its latching position. In its latching position, the cover plate 36 of the door handle 28 registers with and is parallel to the opening 32 in the door panel 26, and the cover plate 36 of the handle projects outwardly into and through the opening 32 with very little clearance between the cover and the opening.

The spring 52 which urges the handle 28 to its latching position, also urges the handle 28 laterally outwardly to a limiting position in which the locator pads 39 on the base 34 of the handle engage an abutment in the form of an annular flange 60 on the outer door panel 26 which surrounds the opening 32. In this limiting position, established by the contact of the locator pads 39 with the flange 60, the cover plate 36 of the handle projects outwardly through the opening 32 into a position of use such that the outer surface 62 of the cover is flush with the outer surface 64 of the outer door panel 26.

Figure 8:
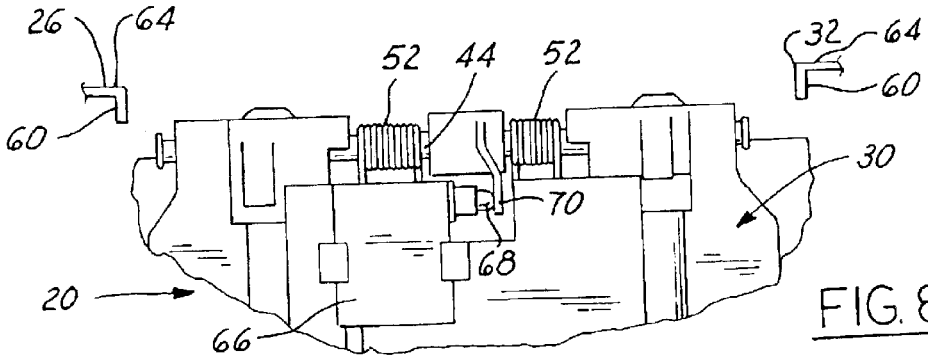
FIG. 8 is a view similar to FIG. 7, but showing the parts in a different position.

A switch 66 is secured on the mounting frame 30. See FIGS. 6–8. A stem 68 is mounted on the switch for axial sliding movement from an extended position to a retracted, operative position. When the handle 28 is in the latching position in which the outer surface 62 of the cover plate 36 is flush with the outer surface of the door panel 26, the stem 68 is depressed by cam 70 against internal spring pressure so that the switch 66 is open. When the handle 28 is pivoted inwardly by hand pressure into the interior space 22 of the door to its unlatching position at a substantial angle to the opening 32, cam 70 on the base 34 of the handle retreats from stem 68 so it can extend under spring pressure to its operative, extended position to activate the switch 66, sending an electric current through a receptacle 72 to a door latch unlatching mechanism 74 to actuate the mechanism and thereby unlatch the door.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A vehicle door and door handle assembly, comprising:

a vehicle door having an interior space defined in part by an outer door panel having an opening communicating with said interior space, a mounting frame, a door handle, a pivot assembly comprising interengaging hinge parts on said frame and on said door handle mounting said door handle on said frame for swinging movement from a door latching position to a door unlatching position, said mounting frame being secured to said vehicle door in the interior space of the vehicle door in a position such that when the door handle is in the door latching position, the door handle registers with and is generally parallel to the opening, and when the door handle is in the door unlatching position, the door handle extends into the interior space at a substantial angle to the opening, said hinge parts having a loose interengagement providing a floating axis for the swinging movement of said door handle and enabling said door handle to be shifted laterally outwardly into contact with an abutment to a position of use in which an outer surface of said handle is flush with an outer surface of said door panel surrounding said opening, and said door handle being biased laterally outwardly into contact with said abutment.

2. The vehicle door and handle assembly of claim 1, wherein said abutment comprises a flange on an inner surface of the door panel adjacent to said opening.

3. The vehicle door and handle assembly of claim 2, wherein said flange surrounds said opening and extends inwardly from the inner surface of said outer door panel.

4. The vehicle door and handle assembly of claim 1, wherein one of said hinge parts comprises a hinge pin and another of said hinge parts comprises spaced apart hinge knuckles having aligned apertures receiving said pin, said apertures being oversized relative to said pin.

5. The vehicle door and handle assembly of claim 4, wherein said hinge pin is on said frame and said hinge knuckles are on said door handle.

6. The vehicle door and handle assembly of claim 5, wherein said abutment comprises an annular flange on an inner surface of the door panel adjacent to said opening, said annular flange surrounding said opening and extending inwardly from the inner surface of the outer door panel.

7. The vehicle door and handle assembly of claim 6, wherein said door handle has locator pads which engage said flange in the position of use.

8. The vehicle door and handle assembly of claim 7, further including a switch for actuating a door latch unlatching mechanism to unlatch the vehicle door, said switch being activated in response to the swinging movement of the door handle to the door unlatching position.

9. The vehicle door and handle assembly of claim 8, wherein said switch includes a movable stem, the stem activating said switch when the stem is moved to an operative position, and a cam on said door handle engagable with said stem and moving said stem to said operative position in response to the swinging movement of said door handle to said door unlatching position.

10. The vehicle door and handle assembly of claim 9, wherein said door handle comprises a base to which said locator pads are attached, and a cover plate on which said outer surface of said handle is formed, said cover plate being removably attached to said base.

* * * * *

UNITED STATES PATENT AND TRADEMARK OFFICE

CERTIFICATE OF CORRECTION

PATENT NO. : 6,923,481 B2
APPLICATION NO. : 10/342784
DATED : August 2, 2005
INVENTOR(S) : Bruderick et al.

It is certified that error appears in the above-identified patent and that said Letters Patent is hereby corrected as shown below:

On Title Page, under "(75) Inventor:", delete "Richard P Thomas, Clarkston MI (US)" and insert --Richmond P Thomas, Clarkston, MI (GB)--.

Signed and Sealed this

Eleventh Day of September, 2007

JON W. DUDAS
*Director of the United States Patent and Trademark Office*